United States Patent [19]

Fuzii et al.

[11] 4,431,169

[45] Feb. 14, 1984

[54] METHOD AND APPARATUS FOR PREVENTING THE INCLUSION OF SLAG INTO THE MOLTEN STEEL TAPPED FROM A CONVERTER

[75] Inventors: Koichiro Fuzii, Kure; Sueki Kubo, Kitakyushu, both of Japan

[73] Assignees: Nisshin Steel Co., Ltd., Tokyo; Kurosaki Refractories Co., Ltd., Fukuoka, both of Japan

[21] Appl. No.: 278,117

[22] Filed: Jun. 29, 1981

[30] Foreign Application Priority Data

Jul. 5, 1980 [JP] Japan ..... 55-92049
Jul. 10, 1980 [JP] Japan ..... 55-94634

[51] Int. Cl.[3] ..... C21B 5/46

[52] U.S. Cl. ..... 266/236; 222/597; 266/227

[58] Field of Search ..... 266/44, 45, 90, 94, 266/99, 227, 272, 236; 222/594, 597, 602, 604

[56] References Cited

U.S. PATENT DOCUMENTS 2,426,644 9/1947 Van Der Pyl ..... 266/240
2,458,236 1/1949 Wolff ..... 263/12
2,668,994 2/1954 Hansen ..... 266/236
2,810,169 10/1957 Hofer ..... 164/337

FOREIGN PATENT DOCUMENTS 44-29564 6/1969 Japan ..... 266/236

*Primary Examiner*—L. Dewayne Rutledge
*Assistant Examiner*—Christopher W. Brady
*Attorney, Agent, or Firm*—Jordan and Hamburg

[57] ABSTRACT

The method for preventing the inclusion of slag into the molten steel tapped from a converter is disclosed. Such method comprises immersing an elongated stopper in a molten steel contained in the converter until the stopper is positioned at a predetermined height above the inside opening of a tap hole, directing the elongated stopper to the inside opening irrespective of tilting of the converter such that the stopper could maintain the predetermined position while allowing a constant flow-out of the molten steel into the tap hole through the space formed between the stopper and the inside opening of the tap hole, and lowering the elongated stopper to close the tap hole when the slag floating above the molten steel is about to flow into the tap hole through the space, whereby the inclusion of the slag into the tapped molten steel can be prevented effectively. The apparatus which can efficiently conduct the above method is also disclosed.

8 Claims, 26 Drawing Figures

METHOD AND APPARATUS FOR PREVENTING THE INCLUSION OF SLAG INTO THE MOLTEN STEEL TAPPED FROM A CONVERTER

BACKGROUND OF THE INVENTION

This invention relates to a method and apparatus for preventing the inclusion of slag into the molten steel tapped from a converter.

In a steel refining by the converter, it is impossible to eliminate the occurrence of slag. When such slag is included in the molten steel in a tapping operation, such slag exists in the tapped molten steel as impurities and dephosphates the molten steel thus degenerating the quality of steel produced. The inclusion of slag also brings an ill-effect on the life of refractories of the vessel which receives the tapped molten steel.

For preventing the inclusion or mixing of slag into the molten steel in a tapping operation while assuring the sufficient yield of molten steel, it becomes necessary to stop the tapping of molten steel when the molten slag is about to be tapped from the tap hole.

As another problem, in the tapping operation, especially at the final stage of the tapping operation, the molten slag floating on the surface of the molten steel is whirled into the flow of the molten steel through the tap hole. It is also necessary to prevent the occurrence of such whirling phenomenon to increase the yield of the tapped molten steel.

Although the ratio of molten slag relative to the molten steel in the converter is different in each steel refining plant, the mean ratio is considered to be approximately 13.0 percent by weight (28.6 percent by volume). The inclusion amount of the slag into the tapped molten steel in the steel receiving ladle takes the values shown in graphs of FIG. 1 and FIG. 2. As readily understood from the graphs, the inclusion amount of slag spirally increases along with the widening of the tap hole.

FIG. 3 shows the relationship between the tapping time and the depth of the molten steel and molten slag above the tap hole in a converter which is gradually tilted to effect the tapping operation, wherein $V_1$ indicates the amount of tapped molten steel free from molten slag and $V_2$ indicates tapped molten slag received by the ladle.

The $V_1$ and $V_2$ amount can be calculated as follows:

$$V_1 = A \cdot C\sqrt{2g \cdot \frac{1.0 + 0.6}{2}} \cdot 300 = 300A \cdot \sqrt{1.6g} = 380A \cdot C\sqrt{g}$$

$$V_2 = A \cdot C\sqrt{2g \cdot \frac{0.6 + 0}{2}} \cdot 3.5 \doteq 3.5A \cdot C\sqrt{0.6g} = 2.7A \cdot C\sqrt{g}$$

From these calculation, $$V_1 : V_2 = 380 : 2.7 \approx 140 : 1$$

In the above formulae, A is the cross sectional area of tap hole, and C is the coefficient of fluidity.

From the above result of the calculation, it is assumed that, if the molten steel and molten slag are distinguished clearly from each other in the tapping operation, the amount of molten slag included in the tapped molten steel in the ladle can be 1/140 (by volume) of the tapped molten steel. However, as discussed above, the inclusion ratio of slag is about 1/20 in an actual tapping operation. This is reasoned as follows. Namely, in the final stage of the tapping operation, the molten steel is tapped from the tap hole in a situation as shown in FIG. 4, where a considerable amount of slag is whirled or included in the tapped molten steel, and such situation continues for several tens of seconds. However, the operator who observes such flow of tapped molten steel judges or considers that molten steel free from the slag is still being tapped from the converter.

Conventionally several methods and apparatuses have been proposed or developed for reducing the amount of slag inclusion in the tapped molten steel.

FIG. 5 shows one of such devices which the applicant of this invention has already disclosed in Japanese Patent Application No. SHO53-78910. The device is substantially characterized by disposing a stopper provided with a weir on the inner opening of the tap hole of a converter, subsequently detecting starting of the slag inclusion to the molten steel and finally dropping the stopper into the tap hole, whereby the discharge of slag is stopped. However, in this method, since the device is provided with the weir as well as the stopper, the structure thereof becomes extremely complicated, and furthermore, it is not possible to lift the stopper from the tap hole after dropping. Accordingly, there is a great possibility that a serious accident may occur by mismanipulation of the device. Still furthermore, since the device is mounted on a movable transport car, the operation before the converter is inconvenient.

FIG. 6 shows another method for preventing the inclusion of slag into the molten steel, wherein the method is characterized by the mounting of sliding nozzle device onto the tap hole of the converter.

This method has successfully reduced the slag inclusion to one fourth of the method which was available before the development of this method. However, in actual or practical operation, especially in terms of maintenance, the method has had several problems and it is less than optimal in preventing the inclusion of slag completely.

FIG. 7 shows still another method for preventing the inclusion of slag into the tapped molten steel, wherein the method is characterized by casting a refractory ball (usually referred to as "slag ball") onto the inner opening of the tap hole just before the starting of the inclusion of molten slag into the molten steel tapped from the tap hole. However, this method also has a problem since the self-setting of the slag ball toward the tap hole was expected in this method.

FIG. 8 shows still another conventional method for preventing the slag inclusion into the tapped molten steel. The method is characterized by mounting a field coil at the tap hole such that the tapped molten steel and slag pass through the coil and detecting the change of impedance between the molten steel and the molten slag and finally stopping tapping operation or splashing the molten slag from the tapped molten steel flow by air. This method can clearly distinguish the molten steel and the molten slag from each other by detecting the sharp difference of impedance, so long as the tapping is in stages where the molten steel and the molten slag flow out from the tap hole as a single-phase flow respectively. However, when the tapping operation is in a transitional stage where the molten slag is whirled into the molten steel flowing through the tap hole, the change of impedance is not apparent so that the detecting of either molten steel flow or molten slag becomes extremely difficult. Accordingly, in the above transitional stage which continues for several tens of seconds, although measures are taken to cope with the stage, for example, the air is applied to the slag-containing molten steel flow to remove the molten slag therefrom or the converter is tilted to stop the tapping of the molten steel, these measures cannot bring about the sufficient slag-cutting effect since no measures are taken for preventing the whirling of slag into the molten steel flow. Therefore, this measure is also less than optimal in complete slag-cutting and thereby suffering the poor yield of the tapped molten steel.

Several conventional methods have been discussed heretofore. However, these methods have disadvantages as well as advantages so that they are less than optimal in providing the satisfying slag-cutting result.

Accordingly, it is an object of the present invention to provide a method and apparatus which can overcome the above mentioned defects of the conventional methods and apparatuses, wherein the inclusion of molten slag into the molten steel tapped from the converter can be minimized, thus greatly enhancing the yield of the tapped molten steel.

The method and apparatus of this invention are, in summary, characterized in that the tap hole is closed by the stopper just prior to the starting of the whirling of the slag into the molten steel tapped through the tap hole and subsequently the tap hole is opened by lifting a stopper providing a steel-flow-out space between the stopper and the inner opening of the tap hole allowing the tapping of the molten steel through the space, whereby the mixing of the slag into the molten steel to be tapped can be reduced as small an amount as possible.

In this specification, the term "stopper" means any closure body (e.g. closure plug, closure bar) which has a contour suitable to close the inner opening of the tap hole completely.

DESCRIPTION OF THE PREFERRED EMBODIMENTS

The apparatus and method of this invention are hereinafter described in detail in conjunction with the attached drawings (FIG. 9 to FIG. 25) which show one of the preferred embodiments of the present invention.

Figure 1:
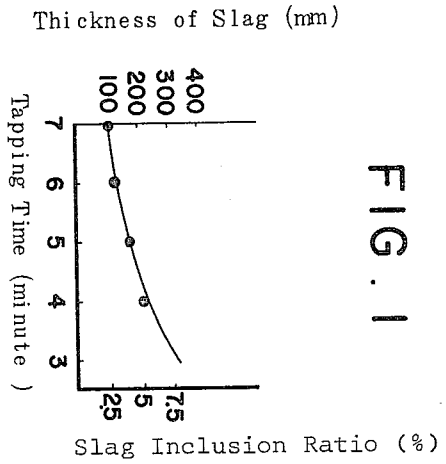
FIG. 1 and FIG. 2 are graphs showing the relationship between the amount of slag inclusion in the ladle and the tapping time and the relationship between the amount of slag inclusion and the number of heats (charges)
Figure 2:
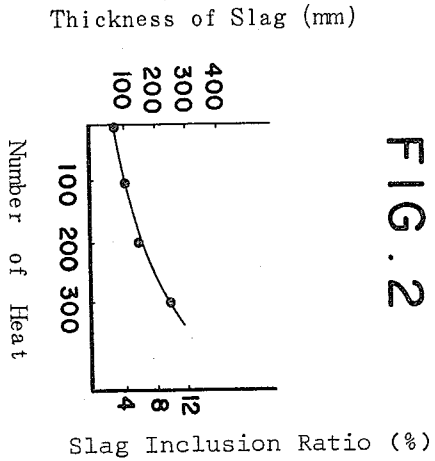
Figure 3:
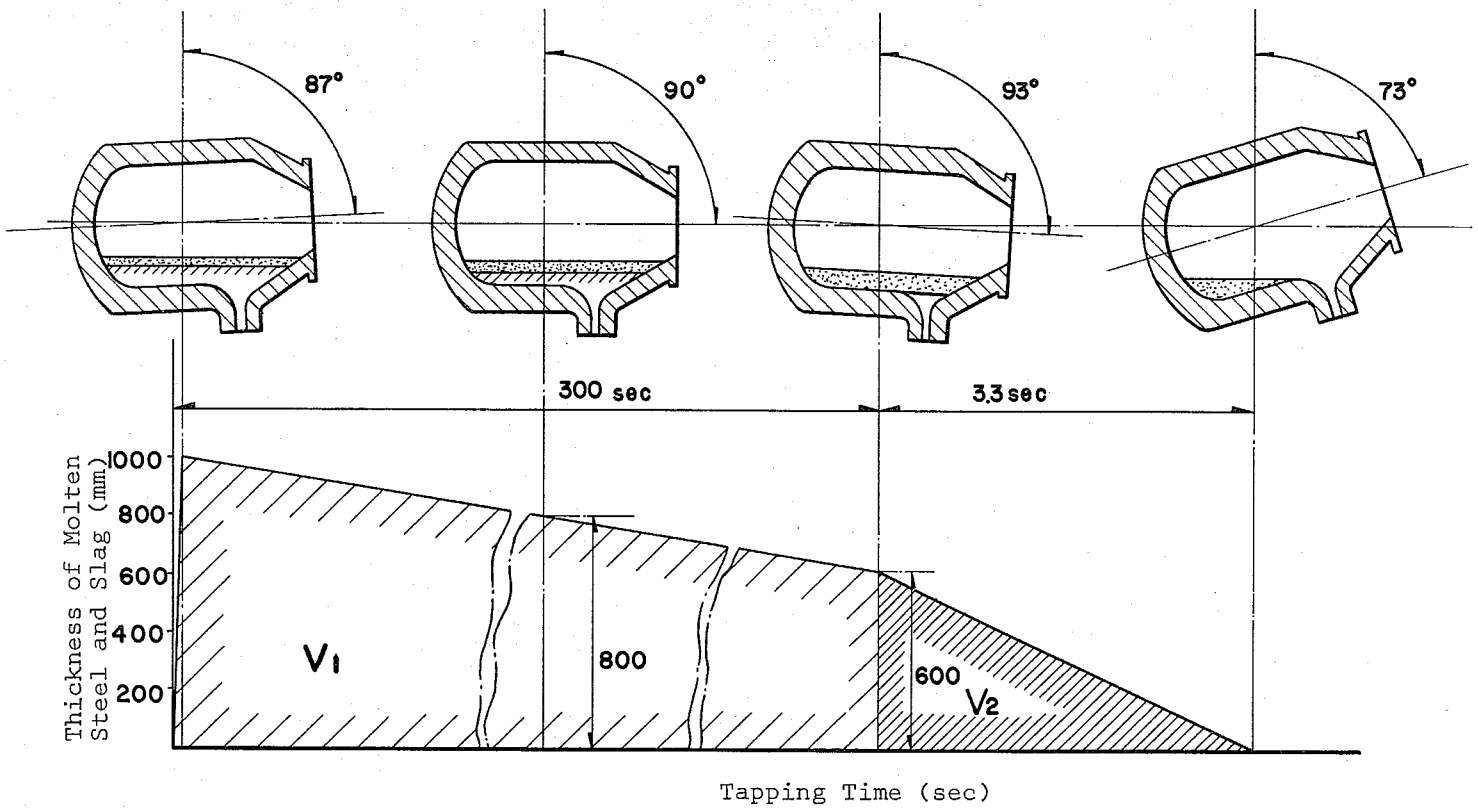
FIG. 3 is a graph showing the relationship between the depth of molten steel and molten slag above the tap hole and the tapping time.
Figure 4:
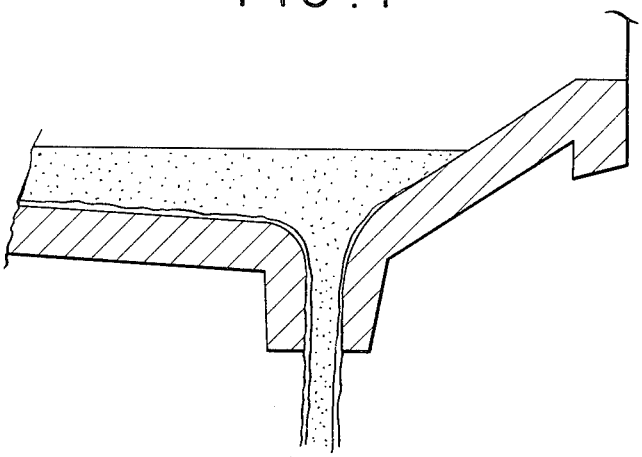
FIG. 4 is an explanatory view showing the mechanism of molten slag whirled into the molten steel flow at the tap hole.
Figure 5:
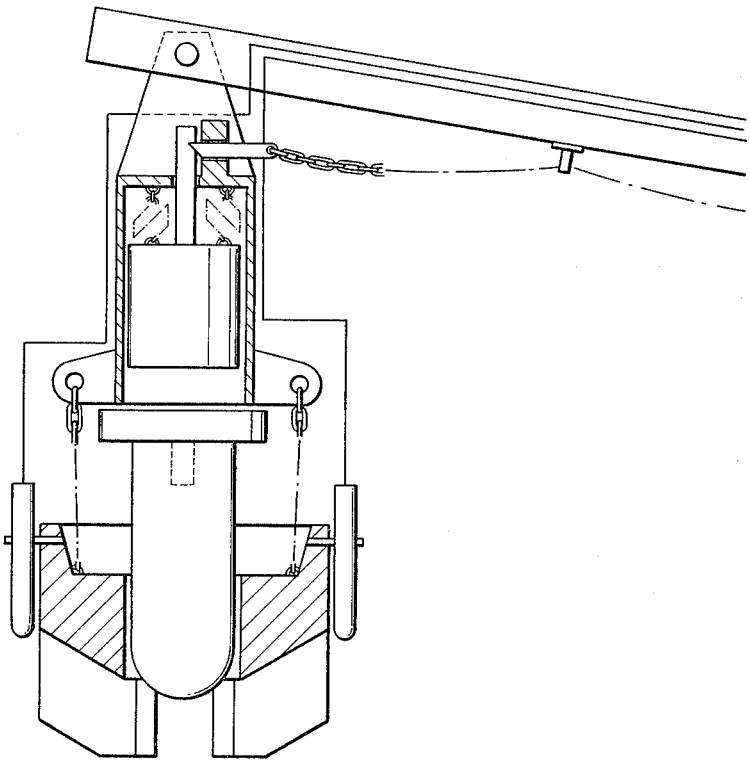
FIG. 5 to FIG. 8 are explanatory views showing several conventional slag-cutting or detecting methods.
Figure 6:
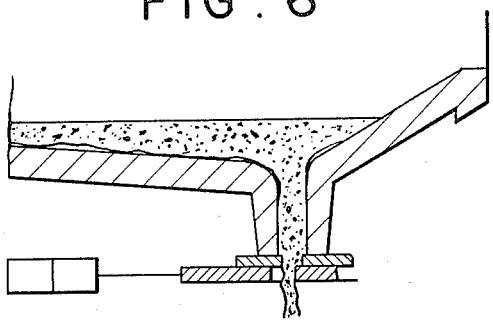
Figure 7:
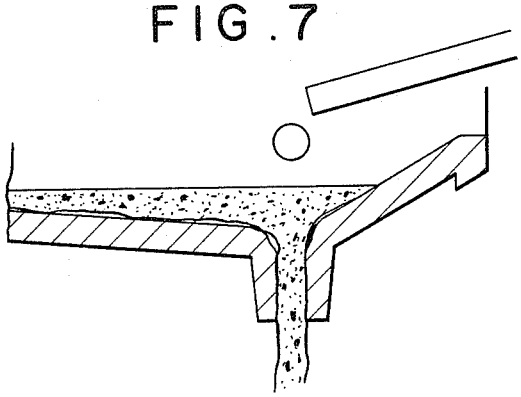
Figure 8:
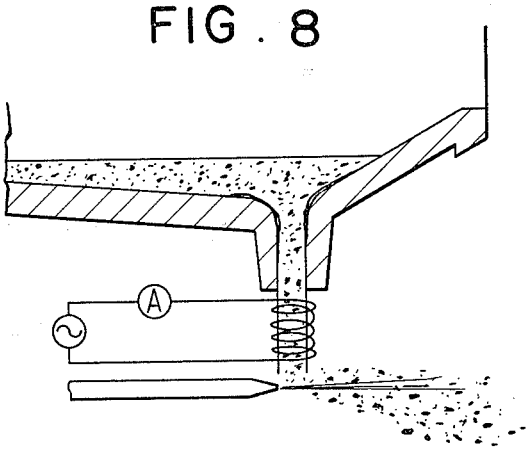
Figure 9:
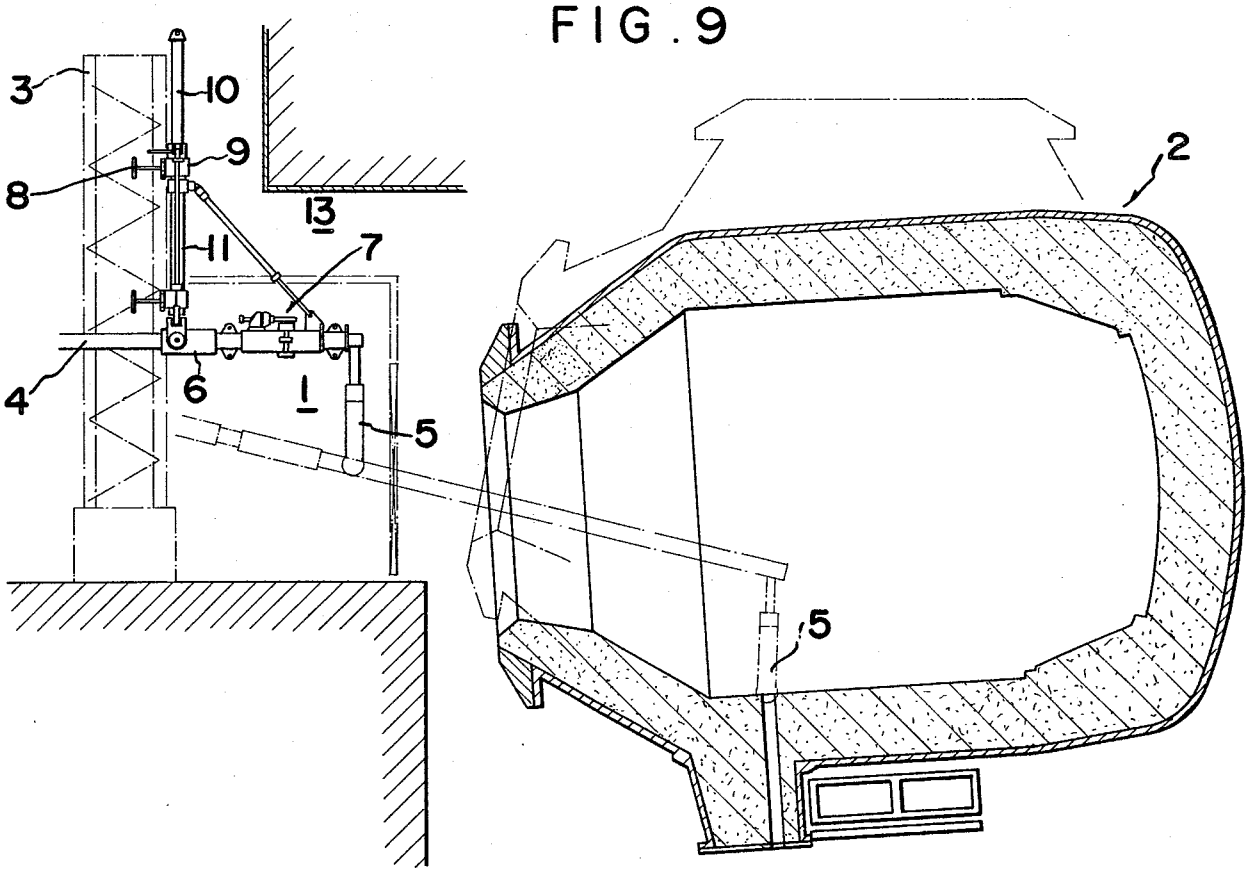
FIG. 9 is a front view of the slag-cutting apparatus of this invention.
Figure 10:
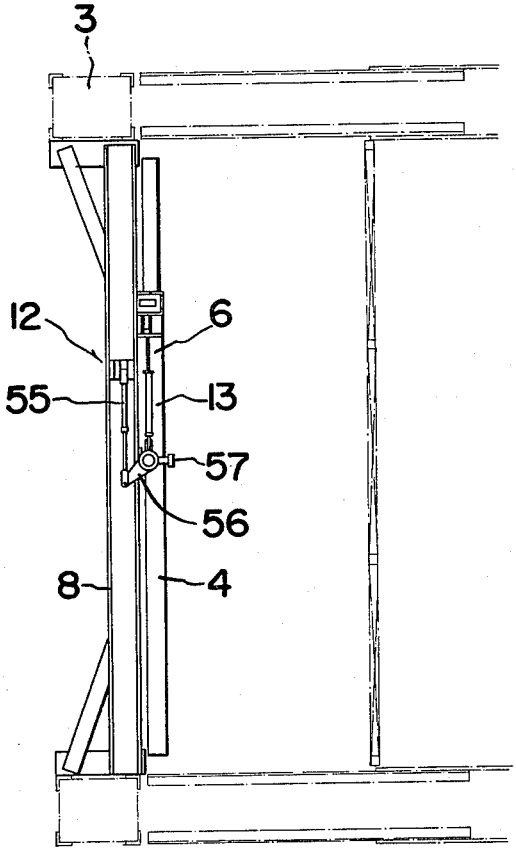
FIG. 10 is a plan view of the above apparatus.
Figure 11:
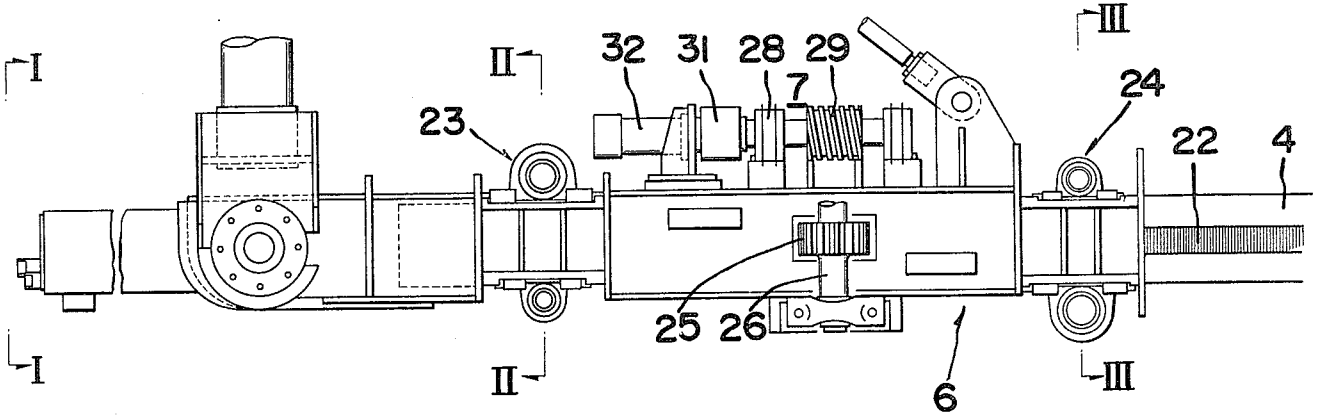
FIG. 11 is an enlarged partial side view of the above apparatus showing the stopper supporting arm, the arm guide sleeve and the arm propelling mechanism.
Figure 12:
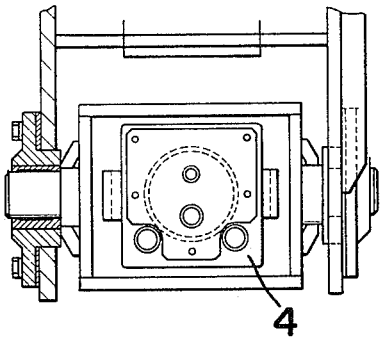
FIG. 12 to FIG. 14 are transverse cross-sectional views of the apparatus taken along the lines I—I, II—II and III—III of FIG. 11 respectively.
Figure 13:
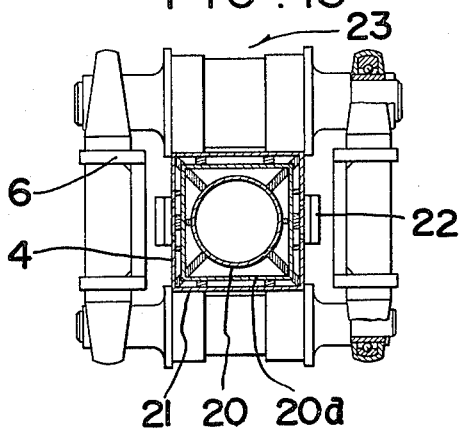
Figure 14:
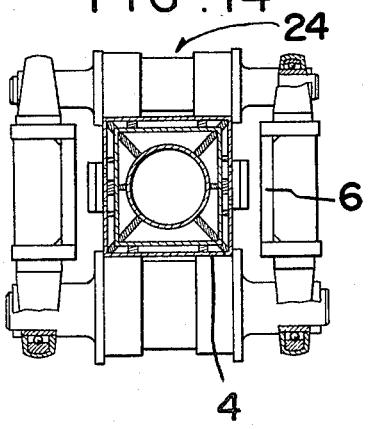
Figure 15:
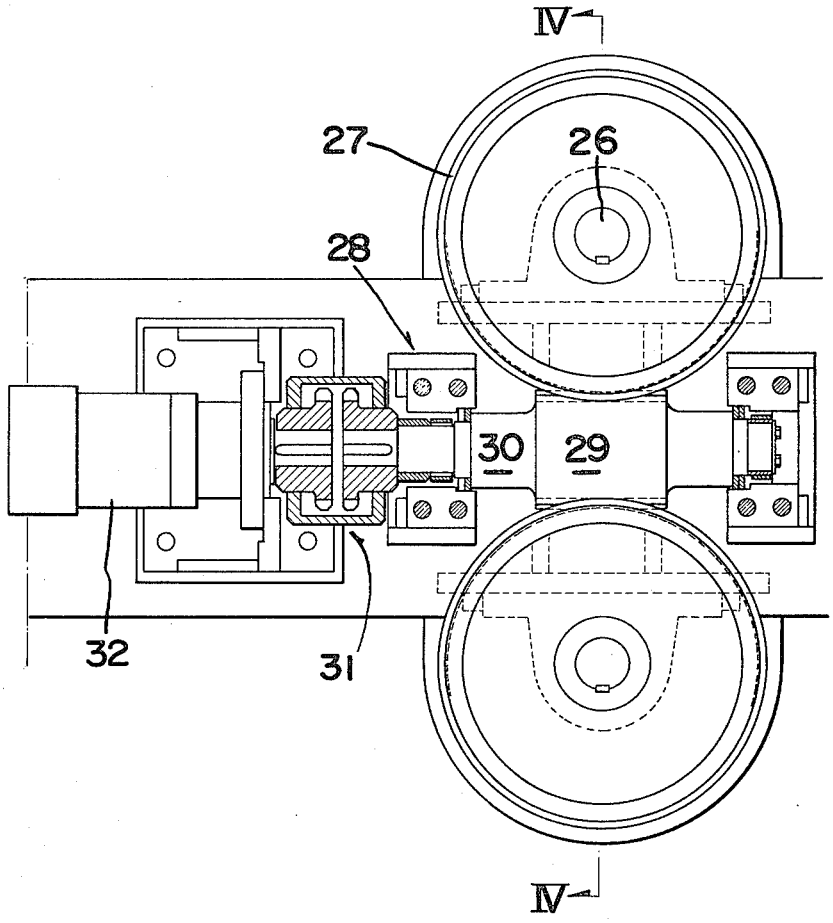
FIG. 15 is an enlarged view of the arm propelling mechanism.
Figure 16:
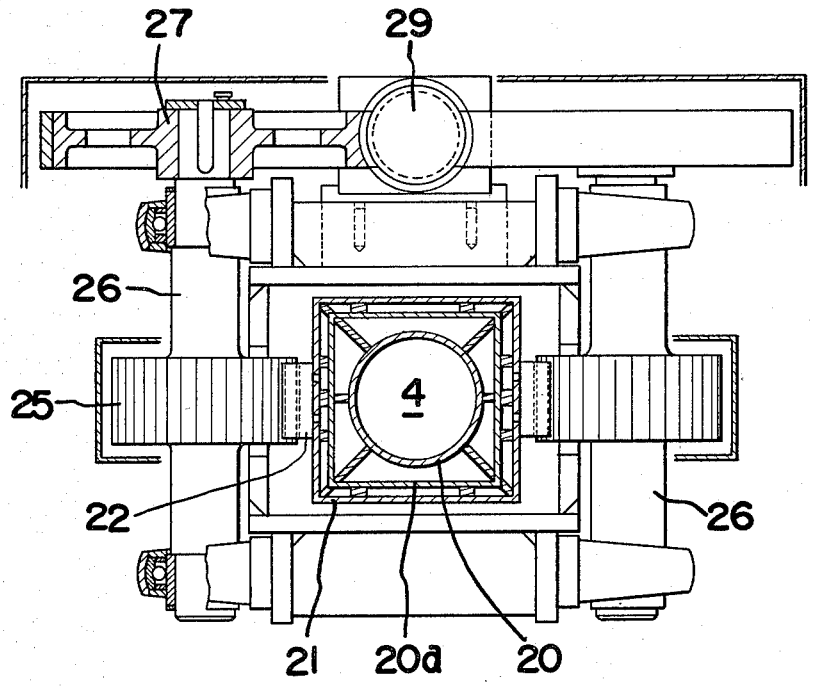
FIG. 16 is a cross-sectional view of the above mechanism taken along the line IV—IV in FIG. 15.
Figure 17:
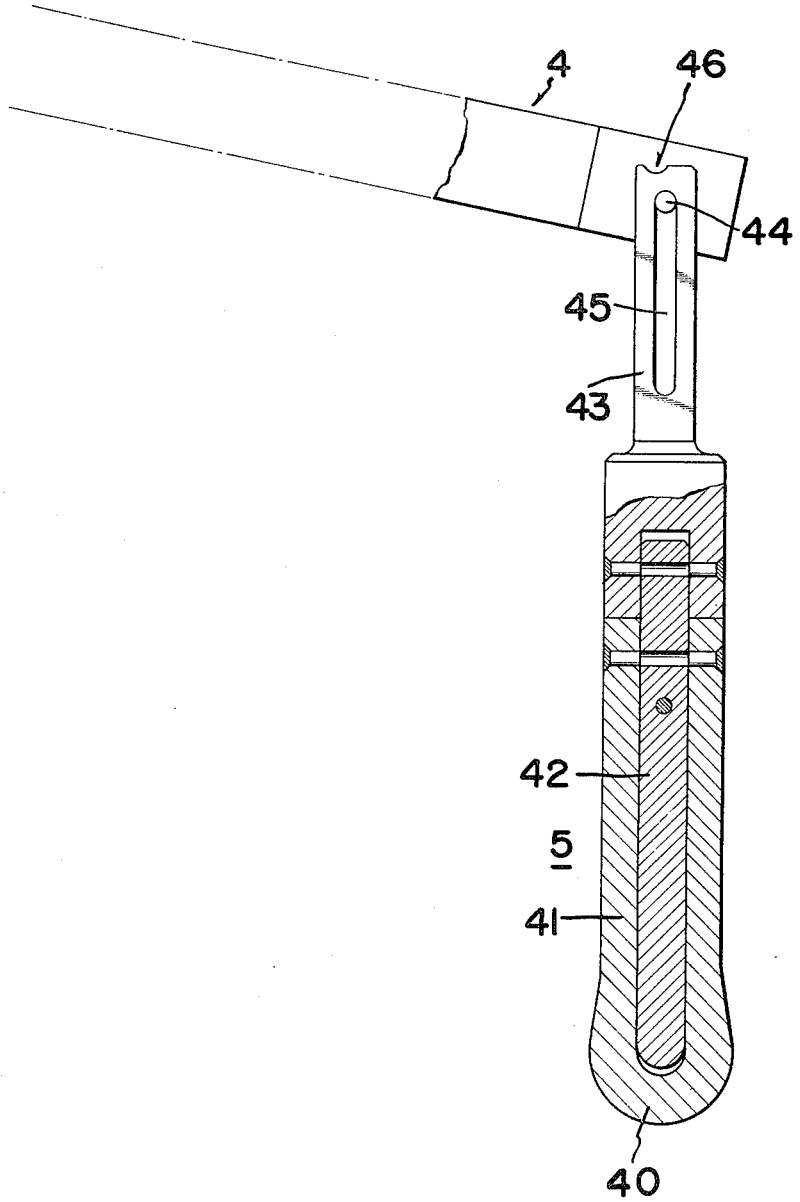
FIG. 17 is an enlarged front view of the stopper partly broken away and in section.
Figure 18:
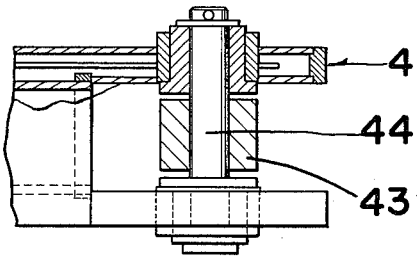
FIG. 18 is an explanatory view showing the manner of connecting the stopper to the stopper supporting arm.
Figure 19:
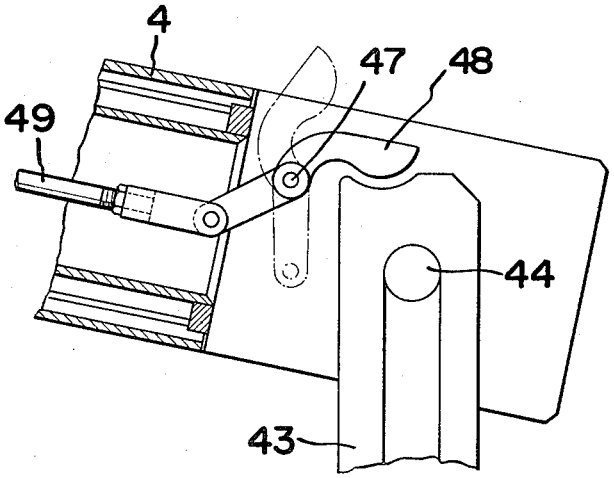
FIG. 19 to FIG. 22 are explanatory views showing the limiting device which adjust the lift of the stopper after temporary setting thereof on the tap hole.
Figure 20:
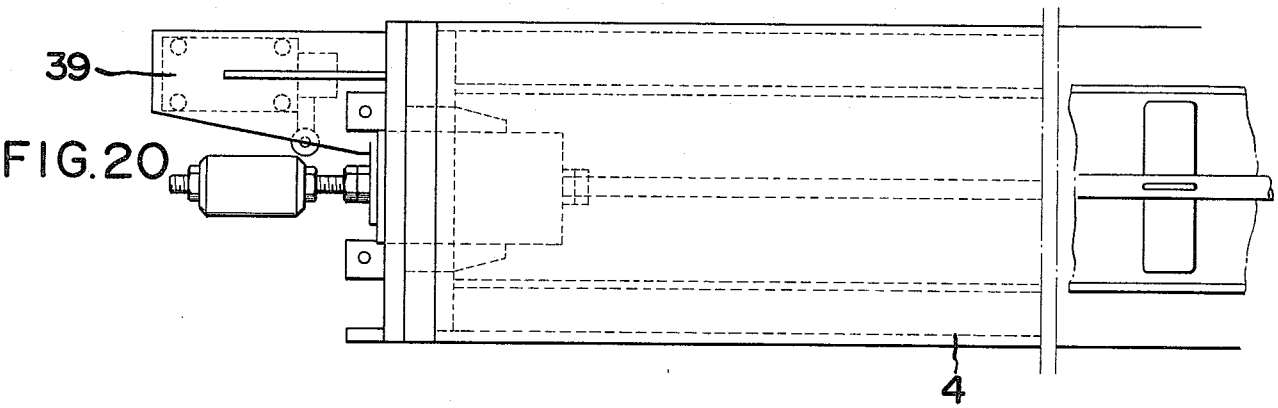
Figure 21:
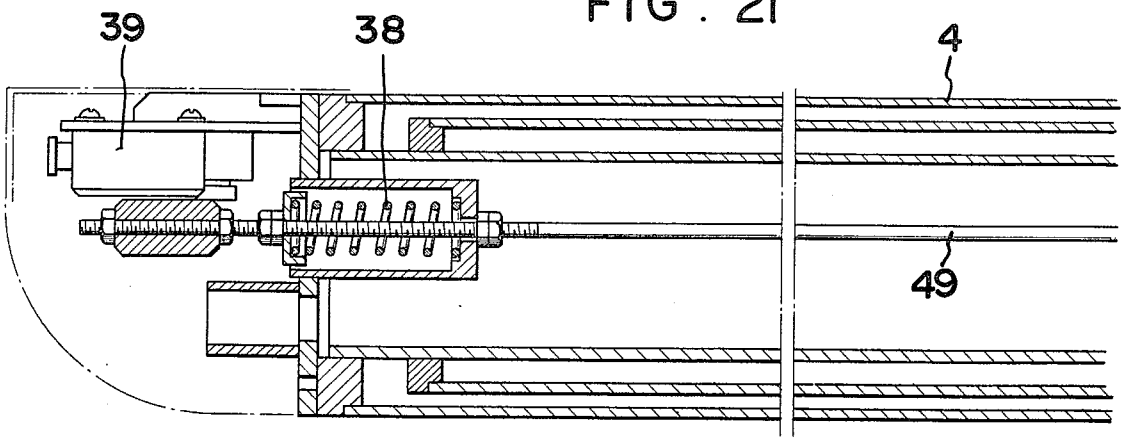
Figure 22:
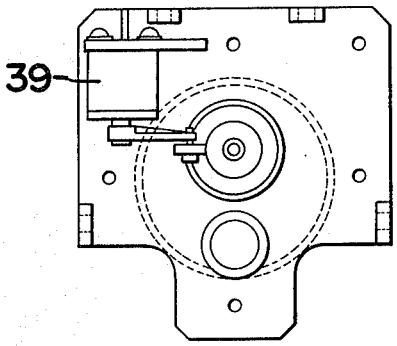

In FIGS. 9 and 10, the entire construction of the slag cutting apparatus 1 is disclosed.

In this embodiment, the slag cutting apparatus is mounted on a roof-supporting frame structure stood on the working floor behind a converter 2 in the shape of a jib crane. The apparatus virtually comprises a stopper supporting arm 4 which is held substantially above and parallel to the working floor behind the converter, an elongated refractory stopper 5 suitably supported at the extremity of the stopper supporting arm, an arm guide sleeve 6 which longitudinally and reciprocably encases the stopper supporting arm, an arm propelling mechanism 7 which reciprocably extends or retracts the stopper supporting arm 4 into the converter 2 relative to the arm guide sleeve 6, a vertical arm support 10 having the lower end thereof pivotally connected to the proximal end of the arm guide sleeve 6 and an intermediate portion thereof elevatably and rotatably mounted on a transverse mounting rib 8 of the roof supporting frame structure 3 by means of bearings 9, an arm elevating mechanism 11 disposed vertically and parallel to the arm supporting shaft 10 so as to elevate the stopper supporting arm 4, an arm turning mechanism 12 disposed parallel to the transverse mounting rib 8 so as to turn the nozzle supporting arm 4 on an axis of the vertical supporting shaft 10, and an arm tilting mechanism 13 which has one end pivotally connected to an intermediate part of the vertical arm supporting shaft 10 and the other end pivotally connected to the front extremity of the arm guide sleeve 6.

The elements of above construction are shown in FIG. 11 to FIG. 16 in detail.

In FIG. 11 to FIG. 16, the structures of the stopper supporting arm 4, the arm guide sleeve 6 and the arm propelling mechanism 7 are shown in greater detail.

As shown in these Figures, the stopper supporting arm 4 is constructed as an elongated steel pipe having a square cross-section.

The nozzle stopper 5 is suitably supported at one end of the stopper supporting arm 4. The arm 4 is of a duplicate pipe construction consisting of an inner tube 20, intermediate tube **20*a* and an outer tube 21. Such tubes define the cooling water circuit along and within the stopper supporting arm 4. The arm 4 is also provided with an elongated rack 22 on both outer surfaces wherein the rack 22 meshes with a pinion 25 which is described later. The arm guide sleeve 6 which reciprocably encases the stopper supporting arm 4 therein also has virtually an elongated box construction and is provided with guide roller mechanisms 23 and 24 for assuring the smooth extending and retracting of the stopper supporting arm relative to the arm guide sleeve 6. The arm propelling mechanism 7 is mounted on an intermediate portion of the arm guide sleeve 6, and comprises a pinion 25 which is mounted on both sides of guide sleeve 6 so as to mesh with the rack 22, a worm wheel 27 being mounted on a pinion mounting shaft 26** in the same manner.

A drive shaft 30 which has both ends rotatably supported by bearings 28 and has an intermediate portion thereof provided with a worm geer 29 which meshes with the above mentioned worm wheel 27, and an arm propelling motor 32 transmits the rotation to the drive shaft by means of a coupling 31.

Since the stopper supporting arm 4, the arm guide sleeve 6 and the arm propelling mechanism 7 have the above mentioned combination, when the arm propelling motor 32 is driven, the pinion 25 imparts a force in an axial direction to the stopper supporting arm 4 by way of the rack 22, thus propelling the arm 4 in a desired longitudinal direction.

In FIGS. 17 to 22, the structure of the elongated refractory stopper 5 is shown in detail. As shown in these drawings, the stopper 5 substantially comprises a tubular refractory stopper 41 which has a spherical portion at the bottom thereof, a weight adjusting core 42 which is inserted in the above tubular refractory stopper 41, and a stopper suspending bar 43 which is connected with the top of the weight adjusting core 42.

The stopper suspending bar 43 is provided with a vertically elongated aperture on the upper portion thereof and such aperture is engaged with a pivot shaft 44 mounted on the extremity of the stopper supporting arm 4 so as to enable the arm 4 to tiltably suspend the stopper 5 and to absorb the shock which the stopper receives when the stopper comes into contact with the inner opening of the tap hole. The stopper supporting bar 43 is also provided with a recess 46 on the top thereof. A rotating lever 48 which has an intermediate part thereof pivoted at 47 on the front extremity of the stopper supporting arm 4 has one end thereof which comes into contact with the recess 46. The rotating lever 48 has another end connected with a limit device 39 shown in FIGS. 19 to 22 by means of an elongated connecting rod 49 and spring 38, both of which are encased in the stopper supporting arm 4.

Due to the above construction, the nozzle stopper 5 can adjust the amount of lift after coming into contact with the inner opening of the tap hole as will be described later.

Figure 24:
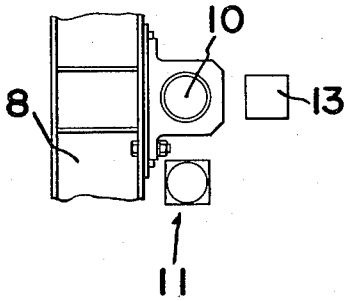
FIG. 23 to FIG. 25 are explanatory views showing the vertical arm supporting shaft, the arm elevating mechanism and the arm turning mechanism.
Figure 23:
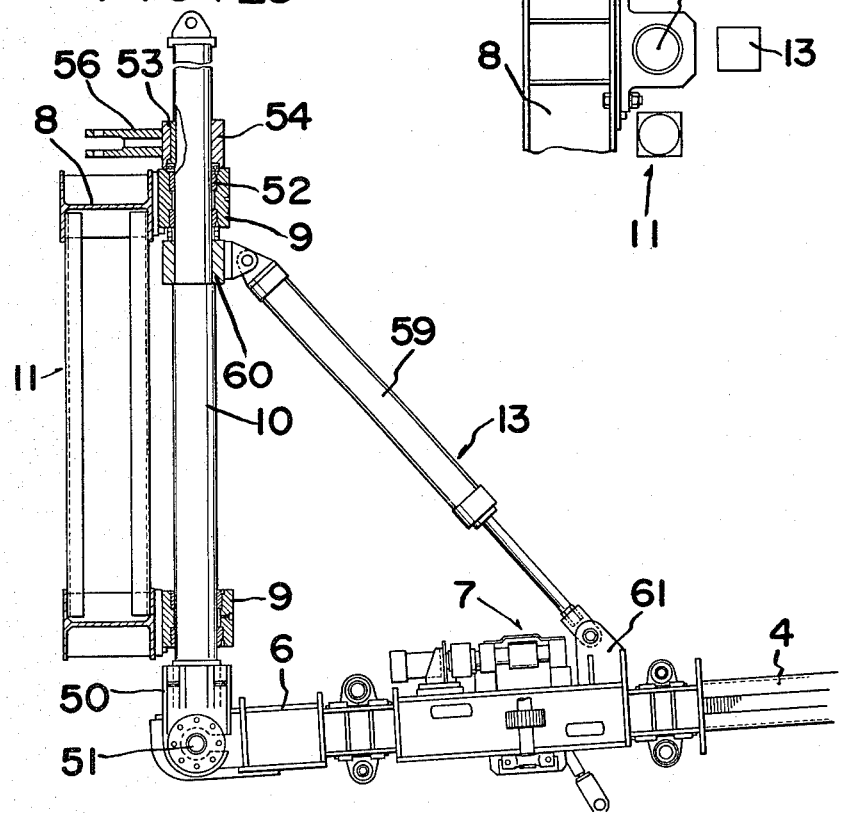
Figure 25:
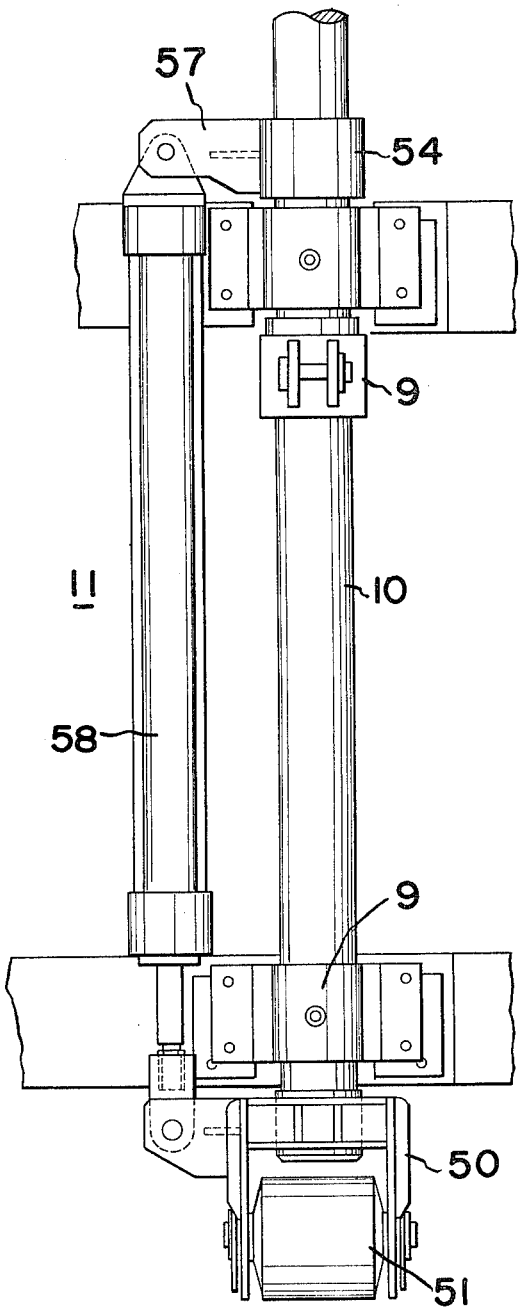

In FIGS. 23 to 25, the structure of the vertical arm supporting shaft 10, the arm elevating mechanism 11 and the arm tilting mechanism 12 is shown in detail.

As shown in these Figures, the vertical arm supporting shaft 10 has the lower trunnion portion 50 thereof pivotally connected with the proximal end of the arm supporting sleeve 6 by means of pivot shaft 51 so as to tiltably support the arm guide 6 and the arm 4.

Furthermore, the vertical arm supporting shaft 10 is elevatably and rotatably (on the axis thereof) mounted on the roof supporting crane structure 3 by means of bearings 9 (preferably provided with thrust bearing 52) attached to the transverse mounting rib 8. The arm supporting shaft 10 secures a stationary boss portion 54 above the upper bearing 9 by means of a key 53 and such stationary boss portion 54 mounts a first bracket 56 thereon to which the distal end of the extending rod of a horizontal hydraulic cylinder 55 is connected. The horizontal hydraulic cylinder 55 works as a mechanism 12 for turning the stopper supporting arm 4. The stationary boss portion 54 is also provided with a second bracket 57 which is disposed approximately perpendicular to the first bracket 56, and the proximal end of a vertical hydraulic cylinder 58 is supported by such second bracket 57, while the vertical hydraulic cylinder 58 has the ends of the extending rod thereof pivotally connected with the trunnion portion 50 of the vertical arm shafting support 10.

The arm tilting mechanism 13 comprises a drive cylinder 59 diagonally extending between the upper end of the vertical arm supporting shaft 10 and an intermediate part of the arm guide 6. To be more specific, the cylinder has one upper end thereof pivotally connected to a stationary boss portion 6 mounted on the vertical arm supporting shaft 10 at a position below the upper bearing 9 and another end (namely, the end of the extending rod) pivotally connected to a bracket 61 secured to the front upper portion of the arm guide sleeve 6.

Since the vertical arm supporting shaft 10, the arm elevating mechanism 11 and the arm turning mechanism 12 and the arm tilting mechanism 13 have the above mentioned construction, the actuation of the vertical hydraulic cylinder 58 causes an integral elevation of the vertical arm shafting support 8 and stopper supporting arm 4, and the actuation of the horizontal hydraulic cylinder 55 causes the turning of the vertical arm supporting shaft 10 and stopper supporting arm 4 around the vertical arm supporting shaft 10, and the actuation of the diagonal hydraulic cylinder 59 causes the integral tilting of the stopper supporting arm and the stopper arm guide sleeve on the trunnion portion 50 of the vertical support shaft 10.

The manner in which the above mentioned apparatus is operated to conduct the slag cutting operation is hereinafter described.

First, the stopper supporting arm 4 and the stopper 5 which are primarily located at a position shown in solid lines are inserted into the converter to take a position shown in broken lines by actuating selectively or integrally the arm turning mechanism 12, the arm elevating mechanism 11, the arm tilting mechanism 13 and the arm propelling mechanism 7.

Subsequently, when the converter 2 is tilted by 90°, the refractory stopper 5 is immersed into the molten steel in the converter 2, and when the converter 2 takes the final tapping angle (93° to 94°), the refractory stopper is lowered until it comes into contact with the inner opening of the tap hole to temporarily stop the tapping operation. Such stoppage continues for a predetermined period, e.g. for 1 to 2 seconds. Then, the refractory stopper is again lifted by a predetermined lift (the amount of lift is adjusted by the limiting device 39) and the tapping operation is resumed through a circular space formed between the lower spherical portion of the refractory stopper and the inner opening of the tap hole. As soon as the molten steel is completely tapped from the tap hole, the refractory stopper 5 is again lowered to effect the slag cutting. Simultaneously the converter 2 is tilted gradually in a reverse direction to an angle where the molten slag left in the converter 2 does not flow out through the tap hole even when the refractory stopper 5 is removed from the tap hole. Then, the refractory stopper 5 is lifted, subsequently the entire slag cutting apparatus is retracted to a position shown in solid lines in FIGS. 9 and 10 by actuating selectively or integrally the arm propelling mechanism 7, the arm elevating mechanism 11, the arm turning mechanism 12 and the arm tilting mechanism 13.

To recapitulate, the method of this invention for preventing the inclusion of slag into the molten steel tapped from a converter comprises the following steps; (i) immersing an elongated stopper in molten steel contained in the converter until the stopper is positioned at a predetermined height above the inside opening of a tap hole, (ii) directing the elongated stopper to the inside opening irrespective of tilting of the converter such that the stopper could maintain the predetermined position while allowing a constant flow-out of the molten steel into the tap hole through the space, and (iii) lowering the elongated stopper to close the tap hole when the slag floating above the molten steel is about to flow into the tap hole through the space, whereby the inclusion of the slag into the tapped molten steel can be prevented effectively.

The above method is characterized in that the occurrence of turbulent flow at the tap hole (namely the phenomenon where the slag floating on the surface of the molten steel is whirled into the molten steel flow tapped through the tap hole) can be prevented and such prevention can be realized by making the refractory stopper to take a position always right above the tap hole irrespective of the tilting of the converter, while maintaining the predetermined space between the stopper and the tap hole, thus deliberately delaying the flowing out of the molten slag through the tap hole.

The inventor of this application has preliminary conducted an experiment to confirm the advantages to be brought about by the method of this invention utilizing water and resin. In this experiment, in the case where the size of the discharge opening was 100 mmϕ, the resin floating on the surface of the water started the whirling thereof into the discharging water when the water level was lowered to 100 mm, while in the case where the size of the discharge opening was 150 mmϕ, the resin started the above-mentioned phenomenon when the water level was lowered to 200 mm. Whereas, in the case where the stopper was disposed at a predetermined height above the water discharge opening, irrespective of the size or diameter of the water discharge opening, the whirling of the resin into the discharging water did not occur until the water level was lowered to 20 to 30 mm.

Based on the above favorable result of the above experiment, the method was applied to the actual slag-cutting operation in the converter, wherein the above slag-cutting operation was conducted exactly in the same manner as described previously.

Namely, when the converter was tilted to a predetermined angle (93° to 94°), the stopper was lowered to the tap hole, thus temporarily stopping the tapping operation. Subsequently, the stopper was lifted at a predetermined height above the tap hole and the tapping of molten steel was resumed through the space between the stopper and the tap hole.

The above slag-cutting operation proved successful, wherein the whirling or inclusion of molten slag into the molten steel flow through the tap hole virtually did not occur until the completion of the tapping operation. This implies that, according to the method of this invention, the whirling of slag into the molten steel flow which is the main cause of the slag inclusion in the tapped steel can be efficiently prevented, thus drastically reducing the total slag amount included in the tapped molten steel from the converter.

Furthermore, due to the application of this method, the clear boundary or border between the molten steel and the molten slag can be maintained throughout the tapping operation.

Therefore, the judgement of the completion of tapping operation (at this stage, the molten steel in the converter is almost entirely tapped out from the converter) can be conducted automatically without relying on the conventional "naked eye" judgement by a skilled operator. Such automatic judgement can be, for example, conducted by (i) electrically connecting the stopper and the shell of the converter by way of the molten steel or the molten slag and detecting the difference of currents, phase, or the generation of electro motive force by a suitable sensor, or (ii) detecting the weight of the molten steel received in the molten-steel receiving vessel such as the ladle. These automatic judgement methods can accurately detect the time at which the molten slag is about to flow out through the tap hole after the completion of the tapping of the molten steel, and can simultaneously transmit a necessary operating signal to any device which lowers the stopper, thus efficiently preventing the flowing out of the molten slag through the tap hole.

As has been described heretofore, the method and apparatus according to this invention has following advantages.

(1) The whirling of slag into the molten steel flow in the tap hole which occurs in the conventional slag-cutting operation can be prevented efficiently.

(2) The amount of molten slag discharged from the tap hole after the completion of the molten steel tapping operation can be minimized, thus enhancing the yield of tapped molten steel. For example, the ratio of slag inclusion relative to the molten steel received in the ladle can be reduced to $\frac{1}{8}$ to 1/10 of the slag inclusion ratio obtained by the conventional slag-cutting methods.

Although the method and apparatus of this invention have been described in view of its application to a converter, it is needless to say that the method and apparatus are also applicable to the molten steel discharge mechanism of other molten steel receiving vessels such as a molten steel receiving ladle, a tundish, or a torpedo car.

A modification of the above slag-cutting method is described hereinafter. In summary, such modification is directed to a method for preventing the inclusion of slag into the molten steel tapped from a converter which comprises following steps: immersing an elongated electrically conductive stopper in a molten steel contained in the converter, the stopper being disposed above an inner opening of a tap hole, lowering the electrically conductive stopper to close the tap hole when the depth of molten steel reaches a predetermined value, lifting the electrically conductive stopper at a predetermined height above the inner opening, while allowing a constant flow-out of the molten steel through a space formed between the inner opening and the electrically conductive stopper, simultaneously electrically connecting the flow-out molten steel with a shell of the converter by means of a first electrical wire and also electrically connecting the shell of the converter with the electrically conductive stopper by means of a second electrical wire, detecting the change of electric current which occurs in a transitional stage of tapping operation from the completion of tapping of the molten steel to the starting of flowing-out of the molten slag, and lowering the electrically conductive stopper to close the tap hole after the detecting of current change.

Theoretically, the electric resistance of molten steel is considered 1/1000 of the corresponding value of the molten slag. However, when the inventor of this application actually measured using a suitable Bridge, Circuit, it was found that such electric resistance was 0.01 Ω to 0.03 Ω for the molten steel and 0.1 Ω to 0.6 Ω for the molten steel. The ratio of electric resistance between them is in the order of more than one digit.

In evaluating the measured result, the following must be taken into account, namely, the accuracy of the measuring device and the slight mixture of molten slag into the molten steel and vice versa. However, it is safe to say that such ratio of electric resistance between molten steel and the molten slag is sufficient to clearly detect the transition of molten steel to molten slag which occurs at the tap hole.

Figure 26:
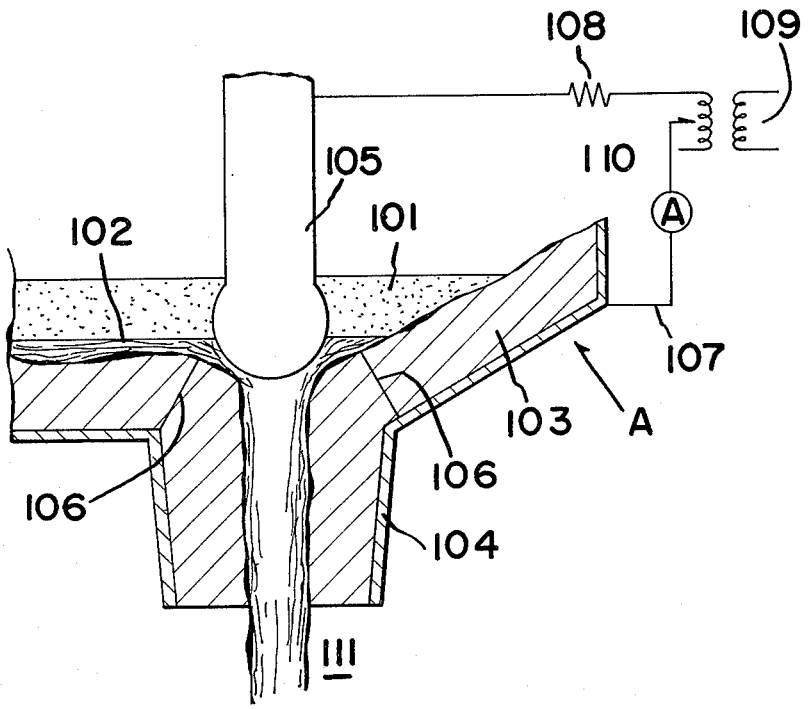
FIG. 26 is an explanatory view showing a modification of the method of this invention.

The detecting method is further explained with regard to the embodiment shown in FIG. 26.

In the FIG. 26, only a tap hole 111 of a converter 104 is shown. And as can be understood readily, the tapping of molten steel 102 is substantially at the final stage and the flowing out of molten slag 101 has not yet started. The tap hole 111 comprises a refractory lining 103 and a shell 104. An electrically conductive stopper 105 is disposed above the tap hole 111. The electrical circuit is completed by connecting the molten steel 102 with the shell 104 by a first electrical wire 106 and the shell 104 with the electrically conductive stopper 105 by a second electrical wire 107, respectively. Numerals 108, 109 and 110 indicate a resistor, a variable transformer and ammeter, all of which are provided on the second electrical wire 107.

In the above method, when the depth (α) of the molten steel in the converter (A) reaches a predetermined level, the electrically conductive refractory stopper 105 is immersed in the molten steel and makes the lower end thereof come into contact with the tap hole so as to temporarily close the tap hole 111. Such stoppage continues for a predetermined period, e.g. for 1 to 2 seconds. Then the refractory stopper is again lifted by a predetermined lift and the tapping operation is resumed through the circular space formed between the lower portion of the electrical conductive stopper 105 and the inner opening of the tap hole 111. Then, so long as the molten steel flows through the tap hole 111, since the electrically conductive stopper 105 and the shell 104 is electrically connected by the molten steel 102, the ammeter 110 on the second electrical wire 107 shows a high current.

Whereas, as the molten slag 101 comes into contact with the lower end of the stopper 105 in lieu of the molten steel 102, since the molten slag 101 has a resistance far higher than that of the molten steel 102, the ammeter 110 shows a low current. Thus, the transition from the molten steel 102 to the molten slag 101 can be readily found by detecting the above current change. Subsequently, the electrically conductive stopper 105 is lowered to close the tap hole 111 completely or to narrow the space between the lower end of the stopper 105 and the inner opening of the tap hole 111, whereby the inclusion of molten slag 101 into the tapped molten steel 102 can be efficiently prevented.

What we claim is:

1. Apparatus for preventing the inclusion of slag into molten steel tapped from a converter comprising:

(a) a water-cooled stopper supporting arm extensible into said converter, (b) an elongated stopper pivotally mounted as a pendulum from said supporting arm, said stopper thereby being adapted to be substantially vertically disposed in said converter, said elongated stopper having the upper end thereof tiltably connected to the extremity of said support arm and the lower end thereof capable of coming into contact with an inner opening of a tap hole in said converter, (c) an arm manipulating means being operable to extend, tilt, rotate and elevate said stopper support arm, and (d) limiting means mounted on said stopper supporting arm, said limiting means being operable to limit the lift of said stopper above said tap hole after having come into contact with the inner opening of said tap hole, whereby the actuation of said arm manipulating means accurately positions said stopper into contact with said inner opening of said tap hole and said limiting means provides for positioning said stopper at a predetermined spaced position above said tap hole for various tilted positions of said converter such that molten slag is thereby delayed from flowing out of said tap hole.

2. Apparatus for preventing the inclusion of slag into molten steel tapped from a converter comprising a water-cooled stopper supporting arm means, said supporting arm means having an extensible member, propelling means on said stopper supporting arm means for longitudinally extending and longitudinally retracting said extensible member, an elongated stopper pivotally mounted as a pendulum on said extensible member, said stopper being adapted to come into contact with the inner opening of a tap hole in the converter, a vertical arm support means pivotably connected to said stopper support arm means, a tilting means pivotally connected to said vertical arm support means and pivotally connected to said stopper supporting arm means, said tilting means being operable to pivot said stopper support arm means relative to said vertical arm support means, a turning mechanism operably connected to said vertical arm support means for rotating said vertical arm support means about a vertical axis, an elevating mechanism for raising and lowering said vertical arm support means, and limiting means mounted on said stopper support arm means, said limiting means being operable to limit the lift of said stopper above said tap hole after having come into contact with the inner opening of said tap hole, whereby said stopper is insertable into said converter as said propelling means extends said extensible member, said limiting means providing for positioning said stopper at a predetermined spaced position above said tap hole for various positions as said converter is tilted about a horizontal axis such that molted slag is thereby delayed from flowing out of said tap hole.

3. Apparatus according to claim 2 wherein said stopper is movable to said predetermined spaced position relative to said tap hole which relative position is maintained as said converter is tilted to various positions about a horizontal axis.

4. Apparatus according to claim 2 wherein said elevating mechanism is operable to raise and lower said stopper supporting arm means, said stopper and said tilting means as a unit.

5. Apparatus according to claim 2 wherein said turning mechanism is operable to rotate said stopper supporting arm means, said stopper and said tilting means as a unit about a vertical axis coincident with the vertical axis of said vertical arm support means.

6. Apparatus according to claim 2 wherein said propelling means comprises a power operated means mounted on said stopper supporting arm means for extending and retracting said extensible member.

7. Apparatus according to claim 2 wherein said limiting means comprises an arm pivotally mounted on said extensible member, said stopper being engagable with said arm to limit said lift.

8. Apparatus according to claim 7 wherein said limiting means comprises an elongated element pivotally connected to said arm, and means for adjusting said elongated element so as to provide for adjusting the amount of said lift.

* * * * *